US011830665B2

(12) United States Patent
Kim et al.

(10) Patent No.: US 11,830,665 B2
(45) Date of Patent: Nov. 28, 2023

(54) COIL ELECTRONIC COMPONENT

(71) Applicant: SAMSUNG ELECTRO-MECHANICS CO., LTD., Suwon-si (KR)

(72) Inventors: Jae Hun Kim, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 1130 days.

(21) Appl. No.: 16/530,396

(22) Filed: Aug. 2, 2019

(65) Prior Publication Data

US 2020/0294712 A1 Sep. 17, 2020

(30) Foreign Application Priority Data

Mar. 13, 2019 (KR) ..... 10-2019-0028763

(51) Int. Cl.
*H01F 5/00* (2006.01)
*H01F 27/30* (2006.01)
*H01F 27/32* (2006.01)

(52) U.S. Cl.
CPC ..... *H01F 27/306* (2013.01); *H01F 27/32* (2013.01)

(58) Field of Classification Search
CPC ..... H01F 27/306
(Continued)

(56) References Cited

U.S. PATENT DOCUMENTS 10,566,129 B2 2/2020 Yatabe et al.
2012/0274432 A1* 11/2012 Jeong ..... H01F 27/2804 336/192

(Continued)

FOREIGN PATENT DOCUMENTS

CN 104575946 A 4/2015
CN 105742035 A 7/2016

(Continued)

OTHER PUBLICATIONS

Chinese Office Action dated Jul. 13, 2021, issued in corresponding Chinese Patent Application No. 201911119427.2 w/ English Tranlsation.

(Continued)

*Primary Examiner* — Ronald Hinson
(74) *Attorney, Agent, or Firm* — Morgan, Lewis & Bockius LLP

(57) ABSTRACT

A coil electronic component includes a body, an insulating substrate disposed in the body, first and second coil portions respectively disposed on a first surface and a second surface of the insulating substrate opposing each other, first and second lead-out portions each disposed on the first surface of the insulating substrate and exposed to at least two external surfaces of the body, first and second connection conductors disposed on the first surface of the insulating substrate and connecting the first lead-out portion and the first coil portion and connecting the second lead-out portion and the second coil portion, respectively, wherein the first connection conductor and the second connection conductor respectively include a plurality of first connection conductors and a plurality of second connection conductors, and the plurality of first connection conductors are spaced apart from one another and the plurality of second connection conductors are spaced apart from one another.

20 Claims, 6 Drawing Sheets

(58) Field of Classification Search
USPC ..... 336/200
See application file for complete search history.

(56) References Cited

U.S. PATENT DOCUMENTS

| | | | | |
|---|---|---|---|---|
| 2014/0009254 | A1* | 1/2014 | Ohkubo | H01F 17/0033 336/192 |
| 2015/0102891 | A1* | 4/2015 | Yoon | H01F 27/2804 336/200 |
| 2016/0189840 | A1* | 6/2016 | Ahn | H01F 17/04 29/602.1 |
| 2016/0268038 | A1* | 9/2016 | Choi | H01F 27/255 |
| 2016/0276089 | A1 | 9/2016 | Inoue et al. | |
| 2017/0018351 | A1* | 1/2017 | Yatabe | H01F 27/2804 |
| 2018/0012696 | A1 | 1/2018 | Lee et al. | |
| 2018/0096778 | A1 | 4/2018 | Yatabe et al. | |
| 2018/0286561 | A1 | 10/2018 | Shimoichi | |
| 2018/0350506 | A1 | 12/2018 | Nakatsuji et al. | |

FOREIGN PATENT DOCUMENTS

| | | | |
|---|---|---|---|
| CN | 108206088 | A | 6/2018 |
| JP | 2016-178282 | A | 10/2016 |
| JP | 2018-174306 | A | 11/2018 |
| JP | 2018-206952 | A | 12/2018 |
| KR | 10-2015-0114924 | A | 10/2015 |
| KR | 10-1670184 | B1 | 10/2016 |
| KR | 10-2018-0006246 | A | 1/2018 |
| KR | 10-2018-0036610 | A | 4/2018 |
| TW | 201826293 | A | 7/2018 |

OTHER PUBLICATIONS

Korean Office Action dated Mar. 9, 2020 issued in Korean Patent Application No. 10-2019-0028763 (with English translation).

* cited by examiner

COIL ELECTRONIC COMPONENT

CROSS-REFERENCE TO RELATED APPLICATION(S)

This application claims the benefit of priority to Korean Patent Application No. 10-2019-0028763 filed on Mar. 13, 2019 in the Korean Intellectual Property Office, the entire disclosure of which is incorporated herein by reference.

TECHNICAL FIELD

The present disclosure relates to a coil electronic component.

BACKGROUND

An inductor, one type of coil component, is a passive electronic component used in electronic devices along with a resistor and a capacitor.

Among coil components, a thin film coil component may be manufactured by manufacturing a coil substrate by forming a coil on an insulating substrate through a plating method, manufacturing a body by layering magnetic composite sheets including a magnetic power and resin mixed therein on the coil substrate, and forming external electrodes on an external portion of the body.

As electronic devices have been designed to have high performance and reduced sizes, an increased number of coil components have been used in electronic devices and sizes of coil components have been reduced. Accordingly, thicknesses of a thin film coil component and a coil substrate have been reduced.

However, as a coil component has been designed to have a reduced size, stress may be concentrated on a portion in which a lead-out portion is connected to a coil portion in a coil component, which may degrade connection reliability between the lead-out portion and the coil portion.

SUMMARY

An aspect of the present disclosure is to provide a coil component which may improve connection reliability between a lead-out portion and a coil portion.

Another aspect of the present disclosure is to provide a coil component which may prevent separation between a conductor and a body in the component.

According to an aspect of the present disclosure, a coil electronic component may include a body having a first surface and a second surface opposing each other, and a third surface and a fourth surface connecting the first surface to the second surface and opposing each other; an insulating substrate disposed in the body; first and second coil portions respectively disposed on a first surface and a second surface of the insulating substrate opposing each other; a first lead-out portion disposed on the first surface of the insulating substrate and exposed to the first surface and the third surface of the body; a second lead-out portion disposed on the first surface of the insulating substrate and exposed to the second surface and the third surface of the body; a first connection conductor disposed on the first surface of the insulating substrate and connecting the first lead-out portion and the first coil portion; and a second connection conductor disposed on the second surface of the insulating substrate and connecting the second lead-out portion and the second coil portion, wherein the first connection conductor and the second connection conductor respectively include a plurality of first connection conductors and a plurality of second connection conductors, and the plurality of first connection conductors are spaced apart from one another and the plurality of second connection conductors are spaced apart from one another.

According to another aspect of the present disclosure, a coil electronic component may include a body; an insulating substrate disposed in the body; first and second coil portions respectively disposed on a first surface and a second surface of the insulating substrate opposing each other; a first lead-out portion disposed on the first surface of the insulating substrate and exposed to at least two external surfaces of the body; a second lead-out portion disposed on the first surface of the insulating substrate and exposed to at least two external surfaces of the body; a first connection conductor disposed on the first surface of the insulating substrate and connecting the first lead-out portion and the first coil portion; and a second connection conductor disposed on the second surface of the insulating substrate and connecting the second lead-out portion and the second coil portion, wherein the first connection conductor and the second connection conductor respectively include a plurality of first connection conductors and a plurality of second connection conductors, the plurality of first connection conductors are spaced apart from one another and the plurality of second connection conductors are spaced apart from one another, each of the plurality of first connection conductors extends in a diagonal direction with reference to the first to fourth surface of the body between the first coil portion and the first lead-out portion, and each of the plurality of second connection conductors extends in the diagonal direction between the second coil portion and the second lead-out portion.

BRIEF DESCRIPTION OF DRAWINGS

The above and other aspects, features, and advantages of the present disclosure will be more clearly understood from the following detailed description, taken in conjunction with the accompanying drawings, in which.

and

Figure 8:
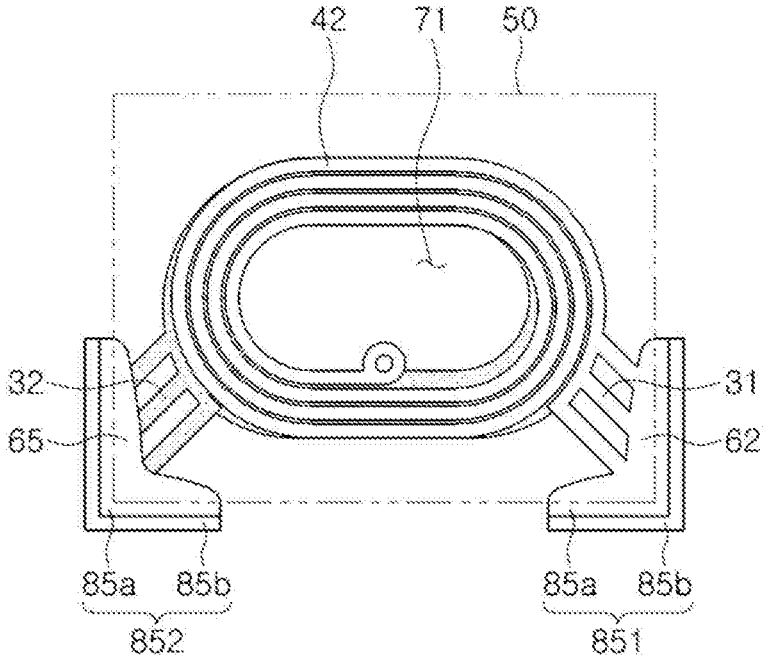

FIG. 8 is a diagram illustrating coil portions of a coil electronic component of a modified example of another example embodiment.

DETAILED DESCRIPTION

Hereinafter, embodiments of the present disclosure will be described as follows with reference to the attached drawings.

The terms used in the following description are provided to explain a specific exemplary embodiment and are not intended to be limiting. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the terms "disposed on," "positioned on," "mounted on," and the like, may indicate that an element may be disposed on or below another element, and do not necessarily indicate that an element is only disposed in an upper portion with reference to a gravitational direction.

It will be understood that when an element is "coupled with/to" or "connected with" another element, the element may be directly coupled with/to another element, and there may be an intervening element between the element and another element.

Sizes and thicknesses of elements illustrated in the drawings are merely examples to help understanding of technical matters of the present disclosure.

In the drawings, an X direction is a first direction or a length direction, a Y direction is a second direction or a width direction, a Z direction is a third direction or a thickness direction.

In the drawings, same elements will be indicated by same reference numerals. Also, redundant descriptions and detailed descriptions of known functions and elements that may unnecessarily make the gist of the present invention obscure will not be provided.

In electronic devices, various types of electronic components may be used, and various types of coil components may be used between the electronic components to remove noise, and other purposes.

In an electronic device, a coil component may be used as a power inductor, an HF inductor, a general bead, a GHz bead, a common mode filter, and the like.

In the description below, an example embodiment in which a coil electronic component 10 is implemented as a thin film inductor used in a power line of a power supply circuit will be described. The coil component in example embodiments may also be implemented as a chip bead, a chip filter, and the like, other than a thin film inductor.

First Example Embodiment

Figure 1:
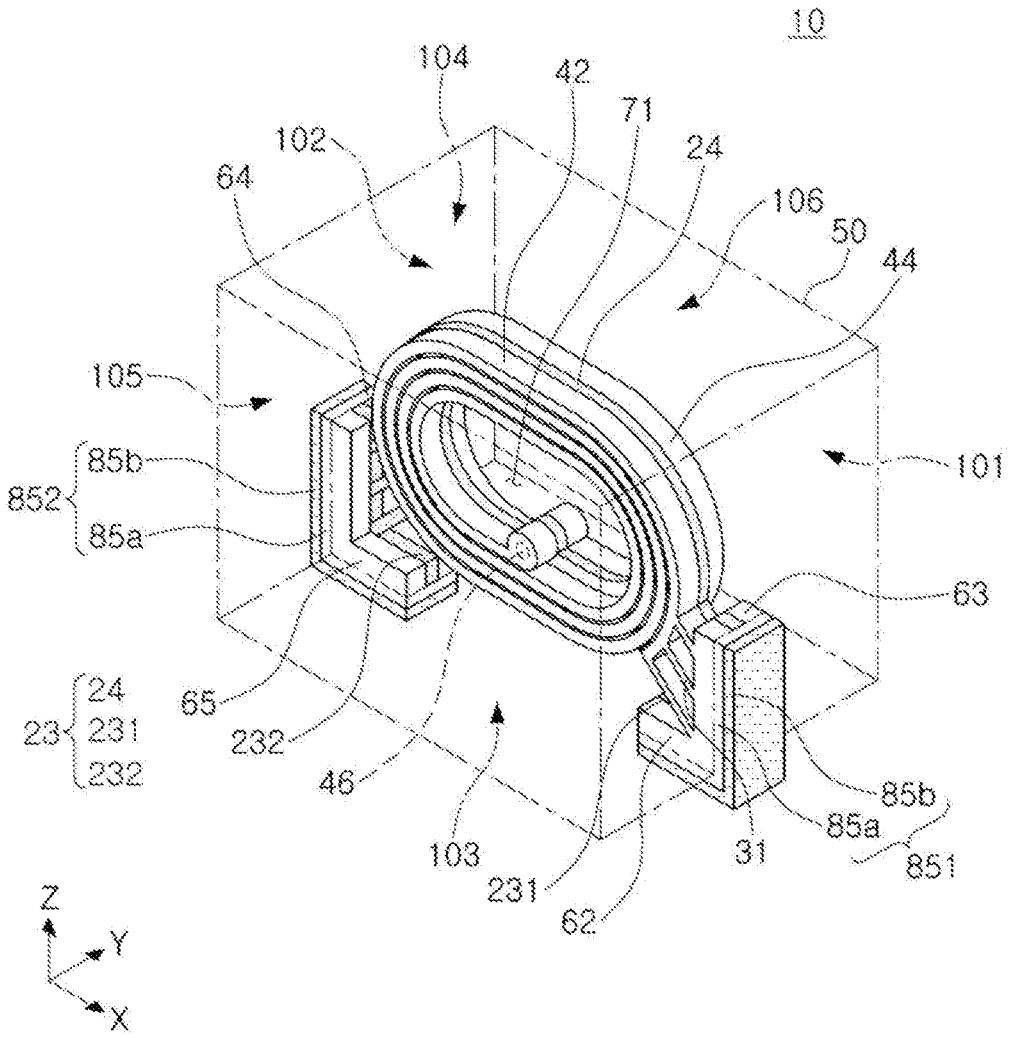
FIG. 1 is a perspective diagram illustrating a coil electronic component according to an example embodiment of the present disclosure.
Figure 2:
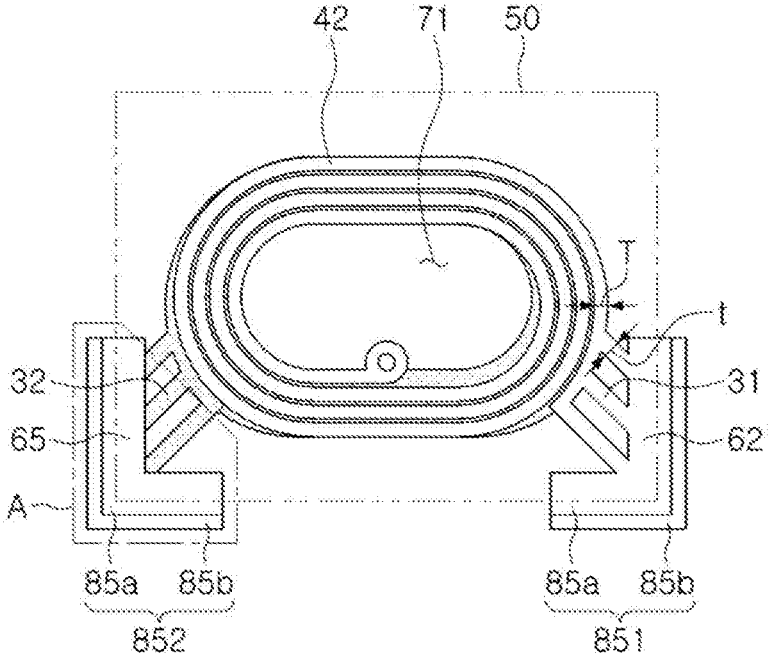
FIG. 2 is a diagram illustrating coil portions of a coil electronic component illustrated in FIG. 1 according to an example embodiment of the present disclosure.
Figure 3:
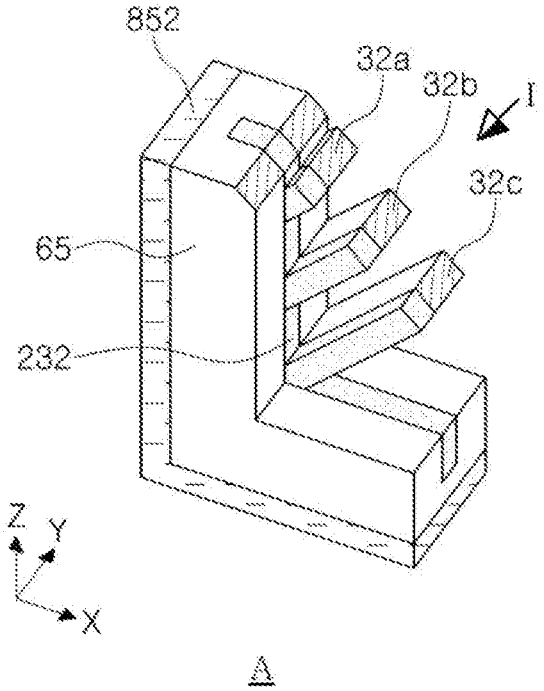
FIG. 3 is a diagram illustrating portion A illustrated in FIG. 2.
Figure 4:
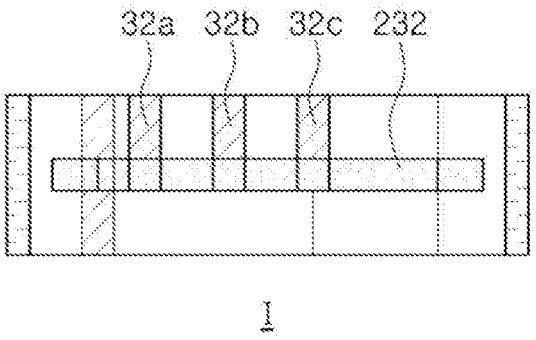
FIG. 4 is a diagram illustrating portion A illustrated in FIG. 3 viewed in an I direction.
Figure 5:
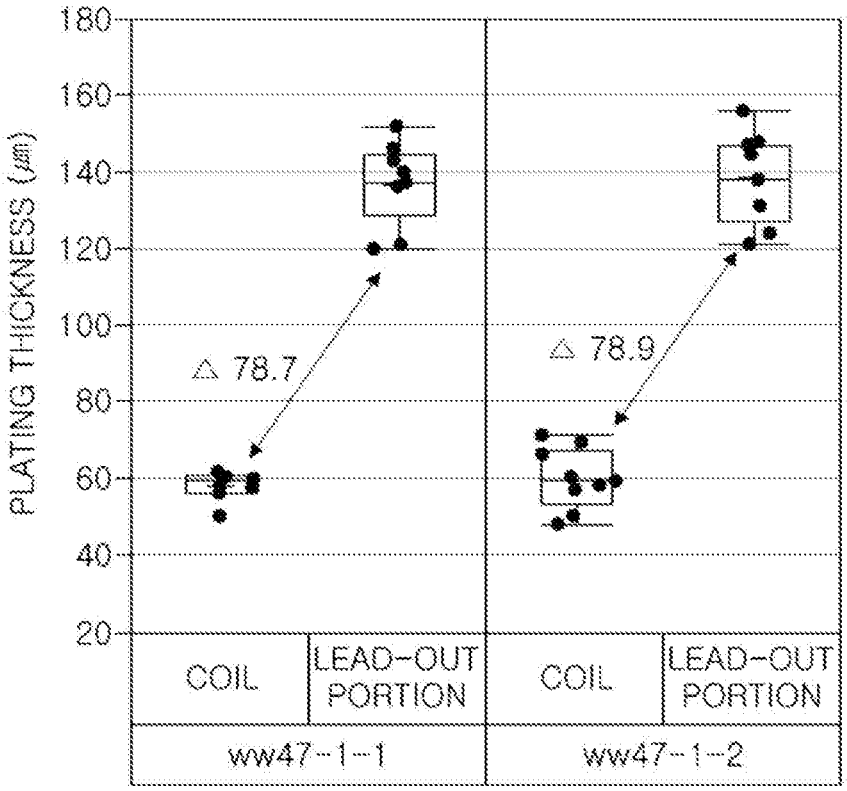
FIG. 5 is graphs illustrating a difference in plating thickness of a line width between a coil portion and a lead-out portion.
Figure 6A:
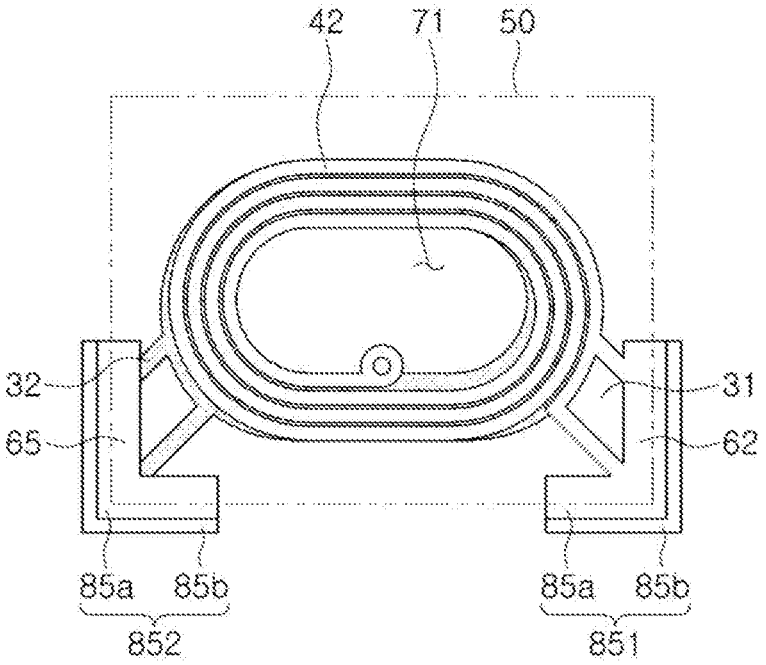
FIGS. 6A-6C are diagrams illustrating coil portions according to a modified example.
Figure 6B:
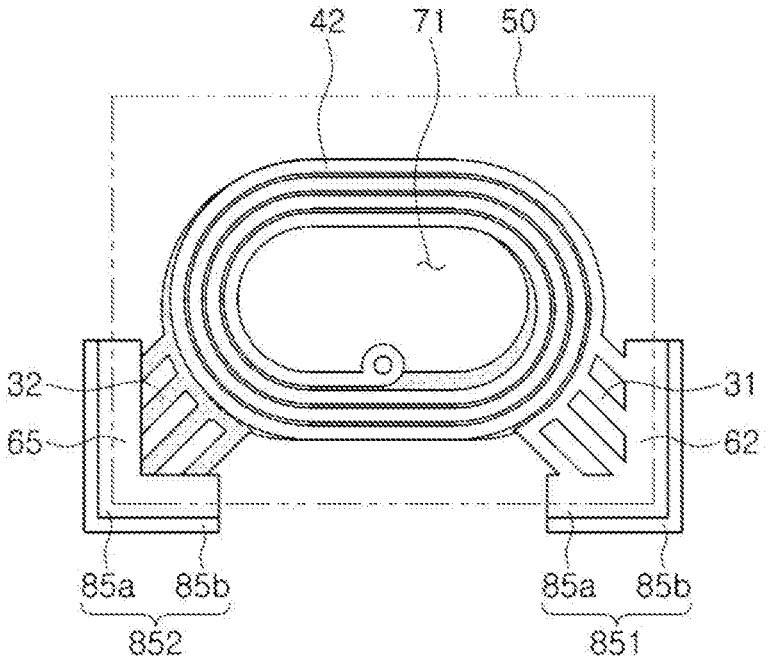
Figure 6C:
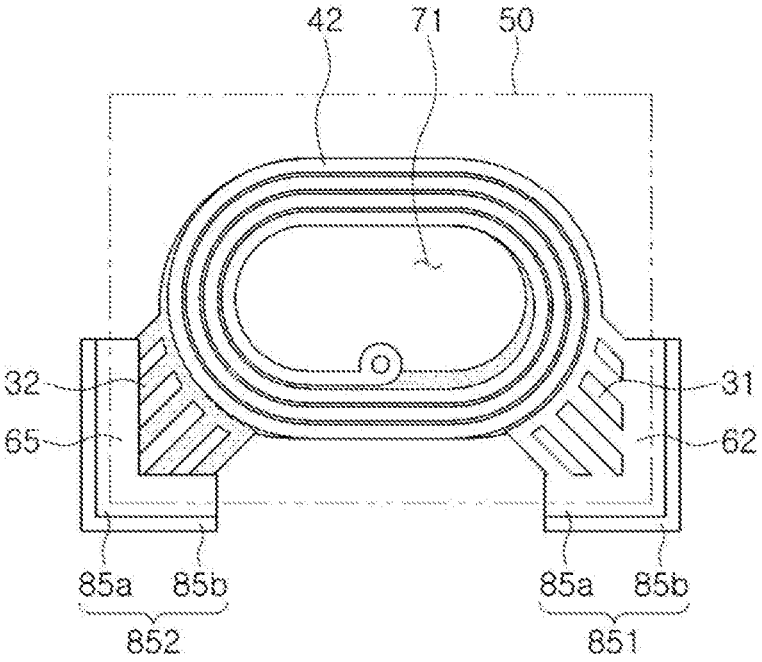

FIG. 1 is a perspective diagram illustrating a coil electronic component according to an example embodiment. FIG. 2 is a diagram illustrating coil portions of a coil electronic component illustrated in FIG. 1 according to an example embodiment. FIG. 3 is a diagram illustrating portion A illustrated in FIG. 2. FIG. 4 is a diagram illustrating portion A illustrated in FIG. 3 viewed in an I direction. FIG. 5 is graphs illustrating a difference in plating thickness of a line width between a coil portion and a lead-out portion. FIGS. 6A-6C are diagrams illustrating coil portions according to a modified example.

Referring to FIGS. 1 to 6A-6C, a coil electronic component 10 may include a body 50, an insulating substrate 23, coil portions 42 and 44, lead-out portions 62 and 64, and connection conductors 31 and 32, and may further include external electrodes 851 and 852 and dummy lead-out portions 63 and 65.

The body 50 may form an exterior of the coil electronic component 10, and may include the insulating substrate 23 disposed therein.

The body 50 may have a hexahedral shape.

The body 50 may include a first surface 101 and a second surface 102 opposing each other in a length direction (X), a third surface 103 and a fourth surface 104 opposing each other in a thickness direction (Z), and a fifth surface 105 and a sixth surface 106 opposing each other in a width direction (Y). The third surface 103 and the fourth surface 104 of the body 50 opposing each other may connect the first surface 101 and the second surface 102 of the body 50 opposing each other.

The body 50 may be configured such that the coil electronic component 10 including the external electrodes 851 and 852 disposed therein may have a length of 0.2±0.1 mm, a width of 0.25±0.1 mm, and a thickness of 0.4 mm, but an example embodiment thereof is not limited thereto.

The body 50 may include a magnetic material and an insulating resin. For example, the body 50 may be formed by layering one or more magnetic material sheets including an insulating resin and a magnetic material dispersed in the insulating resin. The body 50 may also have a structure different from the structure in which a magnetic material is disposed in an insulating resin. For example, the body 50 may be formed of a magnetic material such as ferrite.

The magnetic material may be ferrite power or magnetic metal power.

The ferrite power may be one or more of spinel ferrite such as Mg—Zn based ferrite, Mn—Zn based ferrite, Mn—Mg based ferrite, Cu—Zn based ferrite, Mg—Mn—Sr based ferrite, Ni—Zn based ferrite, and the like, hexagonal ferrite such as Ba—Zn based ferrite, Ba—Mg based ferrite, Ba—Ni based ferrite, Ba—Co based ferrite, Ba—Ni—Co based ferrite, and the like, garnet ferrite such as Y based ferrite, and Li based ferrite, for example.

The magnetic metal power may include at least one of iron (Fe), silicon (Si), chromium (Cr), cobalt (Co), molybdenum (Mo), aluminum (Al), niobium (Nb), copper (Cu), and nickel (Ni) or alloys thereof. For example, the magnetic metal power may be at least one or more of pure iron powder, Fe—Si based alloy power, Fe—Si—Al based alloy power, Fe—Ni based alloy power, Fe—Ni—Mo based alloy power, Fe—Ni—Mo—Cu based alloy power, Fe—Co based alloy power, Fe—Ni—Co based alloy power, Fe—Cr based alloy power, Fe—Cr—Si based alloy power, Fe—Si—Cu—Nb based alloy power, Fe—Ni—Cr based alloy power, and Fe—Cr—Al based alloy power.

The magnetic metal power may be amorphous or crystalline. For example, the magnetic metal power may be Fe—Si—B—Cr based amorphous alloy power, but an example embodiment thereof is not limited thereto.

An average diameter of each of the ferrite power and the magnetic metal power may be 0.1 μm to 30 μm, but an example embodiment thereof is not limited thereto.

The body 50 may include two or more different types of magnetic materials disposed in an insulating resin. The notion that different types of magnetic materials may be included indicates that the magnetic materials may be distinguished from each other by one of an average diameter, a composition, crystallinity, and a shape.

The insulating resin may include one of epoxy, polyimide, a liquid crystal polymer, and the like, or combinations thereof, but an example embodiment thereof is not limited thereto.

The insulating substrate 23 may be disposed in the body 50, and the coil portions 42 and 44 may be disposed in both surfaces of the insulating substrate 23, respectively. The insulating substrate 23 may include a support portion 24 supporting the coil portions 42 and 44, and end portions 231 and 232 supporting the lead-out portions 62 and 64.

The insulating substrate 23 may be formed of a thermosetting insulating resin such as an epoxy resin, a thermoplastic insulating resin such as a polyimide resin, or an insulating material including a photosensitive insulating resin, or may be formed of an insulating material in which a reinforcement such as glass fiber or an inorganic filler is impregnated in the above-mentioned insulating materials. For example, the insulating substrate 23 may be formed of an insulating material such as prepreg, ajinomoto build-up film (ABF), FR-4, bismaleimide triazine (BT), a photoimageable dielectric (PID), or the like, but an example of the material may not be limited thereto.

As the inorganic filler, at least one or more elements selected from among a group consisting of silica ($SiO_2$), aluminum oxide ($Al_2O_3$), silicon carbide (SiC), barium sulfate ($BaSO_4$), talc, mud, mica power, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate (BaTiO3), and calcium zirconate ($CaZrO_3$) may be used.

When the insulating substrate 23 is formed of an insulating material including reinforcement, the insulating substrate 23 may provide improved stiffness. When the insulating substrate 23 is formed of an insulating material which does not include glass fiber, overall thicknesses of the coil portions 42 and 44 may be easily reduced.

The support portion 24 may be disposed between the coil portions 42 and 44 of the insulating substrate 23 and may support the coil portions 42 and 44. The first end portion 231 may extend from the support portion 24, may be disposed between the first lead-out portion 62 and the first dummy lead-out portion 63, and may support the first lead-out portion 62 and the first dummy lead-out portion 63. The second end portion 232 may extend from the support portion 24, may be disposed between the second lead-out portion 64 and a second dummy lead-out portion 65, and may support the second lead-out portion 64 and the second dummy lead-out portion 65.

The coil portions 42 and 44 may be disposed on both surfaces of the insulating substrate 23 opposing each other, and may implement properties of the coil electronic component. For example, when the coil electronic component 10 is used as a power inductor, the coil portions 42 and 44 may maintain an output voltage by storing electric fields as magnetic fields, thereby stabilizing power of an electronic device.

The coil portions 42 and 44 in an example embodiment may be disposed perpendicularly to the third surface 103 or the fourth surface 104 of the body 50.

The notion that the coil portions 42 and 44 may be disposed perpendicularly to the third surface 103 or the fourth surface 104 may indicate that the surfaces of the coil portions 42 and 44 adjacent to the insulating substrate 23 may be disposed perpendicularly or almost perpendicularly to the third surface 103 or the fourth surface 104 of the body 50. For example, the coil portions 42 and 44 may be disposed perpendicularly to the third surface 103 or the fourth surface 104 of the body 50 within an angle of 80 to 100°.

The coil portions 42 and 44 may be disposed in parallel to the fifth surface 105 and the sixth surface 106 of the body 50. Thus, surfaces of the coil portions 42 and 44 in contact with the insulating substrate 23 may be in parallel to the fifth surface 105 and the sixth surface 106 of the body 50.

The coil portions 42 and 44 may include at least one or more conductive layers.

The coil portions 42 and 44 may be formed of a conductive material such as copper (Cu), aluminum (Al), silver (Ag), tin (Sn), gold (Au), nickel (Ni), lead (Pb), titanium (Ti), or alloys, but an example embodiment thereof is not limited thereto.

As a size of the body 50 decreases to a 1608 size or 1006 or less, a thickness of the body 50 may be greater than a width, and an area of a cross-sectional surface of the body 50 taken in an X-Z direction may be greater than an area of a cross-sectional surface taken in an X-Y direction. Accordingly, as the coil portions 42 and 44 are disposed perpendicularly to the third surface 103 or the fourth surface 104 of the body 50, an area in which the coil portions 42 and 44 are disposed may increase.

For example, when a length of the body 50 is 1.6±0.2 mm, and a width is 0.8±0.05 mm, a thickness may satisfy a range of 1.0±0.05 mm (1608 size), and when a length of the body 50 is 0.2±0.1 mm, and a width is 0.25±0.1 mm, a thickness may satisfy a range of a maximum 0.4=(1006 size). As the thickness is greater than the width, the coil portions 42 and 44 may secure a greater area when the coil portions 42 and 44 are disposed perpendicularly to the third surface 103 or the fourth surface 104 of the body 50 as compared to an example in which the coil portions 42 and 44 are disposed horizontally to the third surface 103 or the fourth surface 104 of the body 50. The greater the area of the coil portions 42 and 44, the more inductance (L) and quality factor (Q) may increase.

The first coil portion 42 disposed on one surface of the insulating substrate 23 may oppose the second coil portion 44 disposed on the other surface of the insulating substrate 23, and may be electrically connected to each other through a via electrode 46 disposed on the insulating substrate 23.

Each of the first coil portion 42 and the second coil portion 44 may have a planar spiral form forming at least one turn with reference to a core portion 71 as a shaft. As an example, the first coil portion 42 may form at least one turn on one surface of the insulating substrate 23 with reference to the core portion 71 as a shaft.

The coil portions 42 and 44 and the via electrode 46 may include a metal having high conductivity. For example, the coil portions 42 and 44 and the via electrode 46 may be formed of silver (Ag), palladium (Pd), aluminum (Al), nickel (Ni), titanium (Ti), gold (Au), copper (Cu), platinum (Pt), or alloys thereof, or other elements.

The lead-out portions 62 and 64 may be exposed to the first surface 101 and the second surface 102 of the body 50. For example, the first lead-out portion 62 and the first dummy lead-out portion 63 may be exposed to the first surface 101 of the body 50, and the second lead-out portion 64 and the second dummy lead-out portion 65 may be exposed to the second surface 102 of the body 50.

Referring to FIG. 1, one end of the first coil portion 42 formed on one surface of the insulating substrate 23 may extend and may form the first lead-out portion 62, and the first lead-out portion 62 may be exposed to the first surface 101 and the third surface 103 of the body 50. Also, one end of the second coil portion 44 may extend to the other surface of the insulating substrate 23, opposing the one surface, and may form the second lead-out portion 64, and the second lead-out portion 64 may be exposed to the second surface 102 and the third surface 103 of the body 50.

Referring to FIGS. 1 to 4, the external electrodes 851 and 852 may be connected to the coil portions 42 and 44 through the lead-out portions 62 and 64 disposed in the body 50.

The lead-out portions 62 and 64 may be disposed in the body and may have an "L" shaped form. An area in which the lead-out portions 62 and 64 are disposed may be narrower than a width of the body 50. The lead-out portions 62 and 64 may extend from the first surface 101 and the second surface 102 of the body 50, respectively, and may be led out to the third surface 103, and may not be disposed on the fourth surface 104, the fifth surface 105, and the sixth surface 106 of the body 50. As the lead-out portions 62 and 64 are formed on the third surface 103 of the body 50, the effect of the lead-out portions 62 and 64 interfering with a flow of magnetic flux may decrease such that an inductor performance such as inductance (L), quality factor (Q), and the like, may improve.

The lead-out portions 62 and 64 may include a conductive metal such as copper (Cu), and may be formed in integrated form while the coil portions are plated. As the lead-out portions 62 and 64 formed consecutively on the first to third surfaces of the body 50 are formed in the body 50, a contact area between the lead-out portions and the external electrodes may increase as compared to a general lower electrode structure, and accordingly, a size of the coil electronic component may decrease, and high capacity may be implemented.

The connection conductors 31 and 32 may be disposed on both surfaces of the insulating substrate 23 and may connect the lead-out portions 62 and 64 and the coil portions 42 and 44. For example, the first connection conductor 31 may be disposed on one surface of the insulating substrate 23 and may connect the first lead-out portion 62 and the first coil portion 42, and the second connection conductor 32 may be disposed on the other surface opposing the one surface of the insulating substrate 23 and may connect the second lead-out portion 64 and the second coil portion 44.

Referring to FIGS. 2 and 6, a plurality of the first connection conductors 31 and a plurality of the second connection conductors 32 may be provided, and the plurality of connection conductors 31 and 32 may be spaced apart from each other. Referring to FIGS. 6B and 6C, the number of each of the connection conductors 31 and 32 may be four or five, but an example embodiment thereof is not limited thereto. Referring to FIGS. 2, 6A, 6B, and 6C, as a plurality of the connection conductors 31 and 32 are provided and spaced apart from each other, connection reliability between the coil portions 42 and 44 and the lead-out portions 62 and 64 may improve as compared to a structure in which each of the connection conductors 31 and 32 has a single form. As an example, the first coil portion 42 is connected to the first lead-out portion 62 by the plurality of first connection conductors 31 spaced apart from each other, even when one of the plurality of first connection conductors 31 is broken, electrical and physical connections between the first coil portion 42 and the first lead-out portion 62 may be maintained through the remaining first connection conductors 31.

As the plurality of the connection conductors 31 and 32 are disposed, the body 50 may be charged between the connection conductors 31 and 32. As an example, as a plurality of the first connection conductors 31 are disposed and are spaced apart from each other, the body 50 may be charged in every space between the plurality of first connection conductors 31. Accordingly, cohesion force between the first connection conductor 31 and the body 50 may increase (anchoring effect).

Referring to FIG. 2, when a line width of each of the connection conductors 31 and 32 is t, and a line width of each of the coil portions 42 and 44 is T, t and T may satisfy $T \leq t \leq 2T$. When the line width t of the connection conductors 31 and 32 is less than the line width T of the coil portions 42 and 44, connection reliability between the coil portions 42 and 44 and the lead-out portions 62 and 64 may degrade, and a surface area of the connection conductors 31 and 32 surrounded by a magnetic material may relatively decrease, and accordingly, cohesion force between the connection conductors 31 and 32 and the body 50 may decrease (decrease of anchoring effect). When the line width t of the connection conductors 31 and 32 exceeds twice the line width T of the coil portions 42 and 44, a plating thickness may be greater than a plating thickness of the coil portions 42 and 44, and an area occupied by the line width t of the connection conductors 31 and 32 may be greater than an area occupied by the external electrodes 851 and 852 in the overall coil component. Referring to FIG. 5, when the line width t of the connection conductors 31 and 32 exceeds twice the line width T of the coil portions 42 and 44, the line width t of the connection conductors 31 and 32 may become similar to a plating thickness of the lead-out portions 62 and 64, and accordingly, a deviation in plating thickness between the line width t of the connection conductors 31 and 32 and the line width T of the coil portions 42 and 44 may increase. As a deviation in plating thickness increases, the amount of a magnetic material may decrease in the same volume of a coil electronic component, and mechanical strength and an inductance value of a coil component may degrade.

Referring to FIG. 4, a cross-sectional surface of each of the connection conductors 31 and 32 may have a square shape, and the connection conductors 31 and 32 may be disposed on the insulating substrate 23 and may be supported by the insulating substrate 23. As an example, a 2-1 connection conductor 32*a*, a 2-2 connection conductor 32*b*, and a 2-3 connection conductor 32*c*, each of which has a square shaped cross-sectional surface, may be disposed on the end portion 232. However, an example embodiment thereof may not be limited to the example illustrated in the diagram, and a portion of the insulating substrate 23 supporting the connection conductors 31 and 32 may be removed during a trimming process for processing the insulating substrate 23. In this case, the amount of a magnetic material may further increase.

Although not illustrated in detail, a cross-sectional surface of each of the connection conductors 31 and 32 may include at least one portion having a curved shape. As elasticity rates (Young's modulus) of the body 50 and the coil portions 42 and 44 are different, when stress is applied to the coil electronic component 10, cracks may be created in a portion in which the coil portions 42 and 44 are connected to the external electrodes 851 and 852. By configuring portions of cross-sectional surfaces or overall cross-sectional surfaces of the connection conductors 31 and 32 to be curved, concentration of stress on edge portions may be prevented such that deformation of the coil electronic component 10 may be significantly reduced as compared to an example in which portions of or overall cross-sectional surfaces of the connection conductors 31 and 32 are configured to be straight.

In example embodiments, the coil portions 42 and 44, the lead-out portions 62 and 64, and the connection conductors 31 and 32 may be integrated with one another. For example, the first coil portion 42, the first lead-out portion 62, and the first connection conductor 31 may be integrated with one another, and the second coil portion 44, the second lead-out portion 64, and the second connection conductor 32 may be integrated with one another. A plating resist for forming the coil portions 42 and 44, the lead-out portions 62 and 64, and the connection conductors 31 and 32 may be formed in integrated form, and when the coil portions 42 and 44 are plated, the lead-out portions 62 and 64 and the connection conductors 31 and 32 may be plated together with the coil portions 42 and 44.

The dummy lead-out portions 63 and 65 may be disposed on one surface and the other surface of the insulating substrate 23, opposing each other, to correspond to lead-out portions 62 and 64, respectively. For example, the first dummy lead-out portion 63 may be disposed on the other surface of the insulating substrate 23, and may be configured to correspond to the first lead-out portion 62 disposed on one surface of the insulating substrate 23. The second dummy lead-out portion 65 may be disposed on one surface of the insulating substrate 23, and may be configured to correspond to the second lead-out portion 64 disposed on the other surface of the insulating substrate 23. By further including the dummy lead-out portions 63 and 65 having a shape symmetrical to the lead-out portions 62 and 64, in the coil electronic component 10 in the example embodiment, the external electrodes 851 and 852 may be disposed more symmetrically by a plating process. Thus, the coil electronic component 10 of the example embodiment may be more stably connected to a mounting substrate.

Referring to FIGS. 1 to 4, the external electrodes 851 and 852 may be connected to the coil portions 42 and 44 through the lead-out portions 62 and 64 and the dummy lead-out portions 63 and 65 disposed in the body 50. The dummy lead-out portions 63 and 65 may be electrically connected to the lead-out portions 62 and 64 through a via, and may be directly connected to the external electrodes 851 and 852. As the dummy lead-out portions 63 and 65 are connected to the external electrodes 851 and 852, adhesion force between the external electrodes 851 and 852 and the body 50 may improve. As the body 50 includes an insulating resin and a magnetic metal material, and the external electrodes 851 and 852 include a conductive metal, the body 50 and the external electrodes 851 and 852 may be formed of different materials and may thus not tend to be mixed with each other. Thus, by disposing the dummy lead-out portions 63 and 65 in the body 50 and exposing the dummy lead-out portions 63 and 65 externally of the body 50, additional connection between the external electrodes 851 and 852 and the dummy lead-out portions 63 and 65 may be performed. As the connection between the dummy lead-out portions 63 and 65 and the external electrodes 851 and 852 is connection between metals, adhesion force between the dummy lead-out portions 63 and 65 and the external electrodes 851 and 852 may be stronger than adhesion force between the body 50 and the external electrodes 851 and 852, and thus, adhesion strength of the external electrodes 851 and 852 with the body 50 may improve.

At least one of the coil portions 42 and 44, the via electrode 46, the lead-out portions 62 and 64, the connection conductors 31 and 32 and the dummy lead-out portions 63 and 65 may include at least one or more conductive layers.

As an example, when the coil portions 42 and 44, the lead-out portions 62 and 64, the connection conductors 31 and 32, the dummy lead-out portions 63 and 65, and the via electrode 46 are formed on both surfaces of the insulating substrate 23 by a plating process, each of the coil portions 42 and 44, the lead-out portions 62 and 64, the connection conductors 31 and 32, the dummy lead-out portions 63 and 65, and the via electrode 46 may include a seed such as an electroless plating layer, and an electroplating layer. The electroplating layer may have a single layer structure, or may have a multilayer structure. The electroplating layer having a multilayer structure may be formed in a conformal film structure in which one of the electroplating layers covers the other electroplating layer, or may be formed in a form in which one of the electroplating layers is layered only on one surface of the other electroplating layer. The seed layers of the coil portions 42 and 44, the seed layers of the lead-out portions 62 and 64, the seed layers of the connection conductors 31 and 32, the seed layers of the dummy lead-out portions 63 and 65, and the seed layer of the via electrode 46 may be integrated with one another such that a boundary may not be formed therebetween, but an example embodiment thereof is not limited thereto. The electroplating layers of the coil portions 42 and 44, the electroplating layers of the lead-out portions 62 and 64, the electroplating layers of the connection conductors 31 and 32, the electroplating layers of the dummy lead-out portions 63 and 65, and the electroplating layer of the via electrode 46 may be integrated with one another such that a boundary may not be formed therebetween, but an example embodiment thereof is not limited thereto.

Each of the coil portions 42 and 44, the lead-out portions 62 and 64, the connection conductors 31 and 32, the dummy lead-out portions 63 and 65, and the via electrode 46 may be formed of a conductive material such as copper (Cu), aluminum (Al), silver (Ag), tin (Sn), gold (Au), nickel (Ni), lead (Pb), titanium (Ti), or alloys, but an example embodiment thereof is not limited thereto.

The external electrodes 851 and 852 may be disposed on the first surface 101, the second surface 102, and the third surface 103 of the body 50.

In an example embodiment, the external electrodes 851 and 852 may be disposed on the first surface 101 and the third surface 103 of the body 50 to be connected to the first lead-out portion 62 and the second lead-out portion 64 exposed to the first surface 101 and the third surface 103 of the body 50. An area in which the external electrodes 851 and 852 are disposed may be narrower than a width of the body 50. The first external electrode 851 may cover the first lead-out portion 62, may extend from the first surface 101 of the body 50, and may be disposed on the third surface 103, and may not be disposed on the fourth surface 104, the fifth surface 105, and the sixth surface 106 of the body 50. The second external electrode 852 may cover the second lead-out portion 64, may extend from the second surface 102 of the body 50, and may be disposed on the third surface 103, and may not be disposed on the fourth surface 104, the fifth surface 105, and the sixth surface 106 of the body 50.

The external electrodes 851 and 852 may have a single layer structure or a multilayer structure. Each of the external electrodes 851 and 852 may include a first layer **85*a* covering the lead-out portions 62 and 64, and a second layer 85*b* covering the first layer 85*a*. For example, the first layer 85*a* may include nickel (Ni), and the second layer 85*b* may include tin (Sn) in the coil electronic component 10**.

Further Example Embodiment

Figure 7:
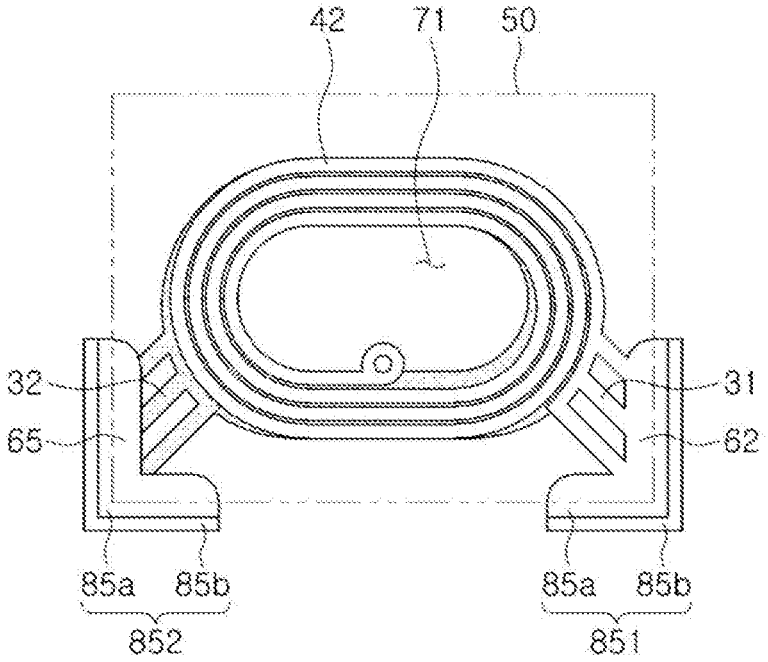
FIG. 7 is a diagram illustrating coil portions of a coil electronic component according to another example embodiment.

FIG. 7 is a diagram illustrating coil portions of a coil electronic component according to another example embodiment. FIG. 8 is a diagram illustrating coil portions of a coil electronic component of a modified example of another example embodiment.

Referring to FIGS. 7 and 8, in the coil electronic component illustrated in the diagrams, shapes of corners of lead-out portions 62 and 64 may be different as compared to the coil electronic component 10 described in the aforementioned example embodiment. Thus, in the example embodiment, only the shapes of the lead-out portions 62 and 64, different from the example described in the aforementioned example embodiment, will be described. The descriptions of the other elements may be the same as in the aforementioned example embodiment.

The lead-out portions 62 and 64 may be disposed in a body 50 and may have an "L" shaped form, and generally, in the lead-out portions 62 and 64 disposed in the body 50, an edge of the lead-out portions 62 and 64 connecting corners thereof may be configured to be a straight line. Referring to FIG. 7, a cross-sectional surface of each of the lead-out portions 62 and 64 disposed in the body 50 may be configured to include at least one portion having a curved shape. Accordingly, a region filled with a magnetic material may increase in the body 50 as compared to the coil electronic component 10 in which cross-sectional surfaces of the lead-out portions 62 and 64 are formed by straight lines. As elasticity rates (Young's modulus) of the body and the coil portions 42 and 44 are different, when stress is applied to the coil electronic component 10, cracks may be created in a portion in which the coil portions 42 and 44 are connected to the external electrodes 851 and 852. Accordingly, by disposing the lead-out portions 62 and 64 such that each of cross-sectional surfaces of the lead-out portions 62 and 64 may have at least one portion having a curved shape in the body 50, a sufficient distance between an outermost turn of the coil portions 42 and 44 and the lead-out portions 62 and 64 may secured, and stress may be dispersed. Also, by disposing the lead-out portions 62 and 64 such that each of cross-sectional surfaces of the lead-out portions 62 and 64 may have at least one portion having a curved shape, stress concentration may be alleviated as compared to the example in which the cross-sectional surfaces are formed by straight lines, thereby significantly reducing the deformation of the coil electronic component 10.

Referring to FIG. 8, overall shapes of cross-sectional surfaces of the lead-out portions 62 and 64 may be configured to be curved. As overall cross-sectional surfaces of the lead-out portions 62 and 64 disposed in the body are configured to have curved shapes, widths of the lead-out portions 62 and 64 in the body 50 may not be uniform. Thus, as compared to the example in which only portions of cross-sectional surfaces of the lead-out portions 62 and 64 have curved shapes, a region filled with a magnetic material may increase in the body 50 and inductance may improve.

According to the aforementioned example embodiments, connection reliability between the lead-out portion and the coil portion may be improved.

Also, separation between the conductor and the body in the coil electronic component may be prevented such that quality of the coil electronic component may be improved.

While the exemplary embodiments have been shown and described above, it will be apparent to those skilled in the art that modifications and variations could be made without departing from the scope of the present invention as defined by the appended claims.

What is claimed is:

1. A coil electronic component, comprising:

a body having a first surface and a second surface opposing each other, and a third surface and a fourth surface connecting the first surface to the second surface and opposing each other;

an insulating substrate disposed in the body;

first and second coil portions respectively disposed on a first surface and a second surface of the insulating substrate opposing each other;

a first lead-out portion disposed on the first surface of the insulating substrate and exposed to the first surface and the third surface of the body;

a second lead-out portion disposed on the first second surface of the insulating substrate and exposed to the second surface and the third surface of the body;

a first connection conductor disposed on the first surface of the insulating substrate and connecting the first lead-out portion and the first coil portion; and a second connection conductor disposed on the second surface of the insulating substrate and connecting the second lead-out portion and the second coil portion, wherein the first connection conductor and the second connection conductor respectively include a plurality of first connection conductors and a plurality of second connection conductors, the plurality of first connection conductors are spaced apart from one another and the plurality of second connection conductors are spaced apart from one another, at least one of the plurality of first connection conductors extends in a diagonal direction with reference to an outer surface of the body between the first coil portion and the first lead-out portion, and at least one of the plurality of second connection conductors extends in a diagonal direction with reference to an outer surface of the body between the second coil portion and the second lead-out portion.

2. The coil electronic component of claim 1, wherein the number of connection conductors in the plurality of first and second connection conductors is three or more, respectively.

3. The coil electronic component of claim 1, wherein, when a line width of each of the plurality of first and second connection conductors is t, and a line width of each of the first and second coil portions is T, t and T satisfy $T \leq t \leq 2T$.

4. The coil electronic component of claim 1, wherein a shape of a cross-sectional surface of each of the first and second connection conductors is a square shape.

5. The coil electronic component of claim 1, wherein a cross-sectional surface of each of the first and second lead-out portions includes at least one portion having a curved shape.

6. The coil electronic component of claim 1, wherein an overall shape of a cross-sectional surface of each of the first and second lead-out portions is curved.

7. The coil electronic component of claim 1, further comprising:

a first dummy lead-out portion disposed on the second surface of the insulating substrate to correspond to the first lead-out portion; and a second dummy lead-out portion disposed on the first surface of the insulating substrate to correspond to the second lead-out portion.

8. The coil electronic component of claim 1, wherein the insulating substrate comprises:

a support portion on which the first and second coil portions are disposed;

a first end portion on which the first lead-out portion is disposed, the first end portion being exposed to the first surface and the third surface of the body; and a second end portion on which the second lead-out portion is disposed, the second end portion being exposed to the second surface and the third surface of the body.

9. The coil electronic component of claim 1, wherein the first coil portion, the first lead-out portion, and the first connection conductor are integrally formed as one piece, and wherein the second coil portion, the second lead-out portion, and the second connection conductor are integrally formed as one piece.

10. The coil electronic component of claim 1, wherein a width of each of the first and second lead-out portions is less than a width of the body.

11. The coil electronic component of claim 1, further comprising:

first and second external electrodes covering the first and second lead-out portions, respectively.

12. The coil electronic component of claim 11, wherein a width of each of the first and second external electrodes is less than a width of the body.

13. The coil electronic component of claim 11, wherein each of the first and second external electrodes comprises:

a first layer disposed on the first or second lead-out portion; and a second layer covering the first layer.

14. The coil electronic component of claim 13, wherein the first layer comprises copper (Cu), and wherein the second layer comprises at least one of nickel (Ni) or tin (Sn).

15. The coil electronic component of claim 1, wherein each of the plurality of first connection conductors extends, in a diagonal direction with reference to the first to fourth surface of the body, between the first coil portion and the first lead-out portion, and wherein each of the plurality of second connection conductors extends in the diagonal direction between the second coil portion and the second lead-out portion.

16. The coil electronic component of claim 1, wherein the first and second coil portions are electrically connected to each other through a via electrode disposed on the insulating substrate.

17. The coil electronic component of claim 1, wherein each of the first coil portion and the second coil portion has a planar spiral form including at least one turn with reference to a center of the body.

18. The coil electronic component of claim 1, wherein the first lead-out portion has an 'L' shape in a plane view parallel with the fifth and sixth surfaces of the body such that portions of the first lead-out portion exposed to the first and third surfaces are connected to each other, and the second lead-out portion has a shape symmetrical to the first lead-out portion with respect to a center axis of the body parallel with a direction connecting the third and fourth surfaces to each other.

19. A coil electronic component, comprising:

a body;

an insulating substrate disposed in the body;

first and second coil portions respectively disposed on a first surface and a second surface of the insulating substrate opposing each other;

a first lead-out portion disposed on the first surface of the insulating substrate and exposed to at least two external surfaces of the body;

a second lead-out portion disposed on the first second surface of the insulating substrate and exposed to at least two external surfaces of the body;

a first connection conductor disposed on the first surface of the insulating substrate and connecting the first lead-out portion and the first coil portion; and a second connection conductor disposed on the second surface of the insulating substrate and connecting the second lead-out portion and the second coil portion, wherein the first connection conductor and the second connection conductor respectively include a plurality of first connection conductors and a plurality of second connection conductors, and the plurality of first connection conductors are spaced apart from one another and the plurality of second connection conductors are spaced apart from one another, each of the plurality of first connection conductors extends, in a diagonal direction with reference to the at least two external surfaces of the body, between the first coil portion and the first lead-out portion, and each of the plurality of second connection conductors extends in the diagonal direction between the second coil portion and the second lead-out portion.

20. The coil electronic component of claim 19, wherein the number of connection conductors in the plurality of first and second connection conductors is three or more, respectively.

* * * * *